US005659948A

United States Patent [19]

Vanderhoof et al.

[11] Patent Number: 5,659,948

[45] Date of Patent: Aug. 26, 1997

[54] TERMINATION TOOL FOR MODULAR TELEPHONE CONNECTOR

[75] Inventors: Russell A. Vanderhoof, Plainfield; Kris B. Lindley, Mokena; Randy S. Mortensen, Orland Park, all of Ill.

[73] Assignee: Panduit Corp., Tinley Park, Ill.

[21] Appl. No.: 343,688

[22] Filed: Nov. 22, 1994

[51] Int. Cl.[6] ..... H01R 43/22; H01R 43/033

[52] U.S. Cl. ..... 29/749; 29/751; 29/758; 7/107

[58] Field of Search ..... 29/267, 749–752, 29/758, 33 M; 7/107; 81/9.4

[56] References Cited

U.S. PATENT DOCUMENTS

| | | | |
|---|---|---|---|
| 3,177,567 | 4/1965 | Gehrman | 29/750 |
| 3,736,606 | 6/1973 | Raum et al. | 7/107 |
| 3,875,601 | 4/1975 | Kaufman | 7/107 |
| 4,194,256 | 3/1980 | Knickerbocker | 7/107 |
| 4,480,374 | 11/1984 | Meyer | 29/751 X |
| 4,567,639 | 2/1986 | Fasaro | 29/751 X |
| 4,713,874 | 12/1987 | Schwartz | 29/751 X |
| 4,920,637 | 5/1990 | Meyerhoefer et al. | 7/107 X |
| 5,118,310 | 6/1992 | Stroede et al. | 439/676 |
| 5,402,561 | 4/1995 | Cerguone et al. | 29/751 |
| 5,412,862 | 5/1995 | Comerc et al. | 29/751 |

FOREIGN PATENT DOCUMENTS

| | | | |
|---|---|---|---|
| 2102484 | 8/1979 | Germany | 29/751 |
| 660935A | 5/1987 | Switzerland | 29/749 |

*Primary Examiner*—Peter Vo

*Attorney, Agent, or Firm*—Mark D. Hilliard; Robert A. McCann

[57] ABSTRACT

A termination tool for terminating a plurality of wires to a modular connector, of the type consisting of a housing adapted to mate with a standard connector and contacts having insulation displacement portions disposed outwardly of the housing and further including a fixture for positioning the wires with respect to the insulation displacement portions. The tool includes a pair of ribs projecting from a first planar contacting section and a second upwardly angled lever section. The tool further includes a vertically oriented blade extending from the generally rectangular front end to untwist twisted wire pairs.

8 Claims, 4 Drawing Sheets

TERMINATION TOOL FOR MODULAR TELEPHONE CONNECTOR

TECHNICAL FIELD

The present invention relates to a simple tool for terminating a plurality of communication wires to a modular connector, and more particularly to a tool adapted to engage with a modular connector of the type consisting of a housing adapted to mate with a standard connector and contacts having insulation displacement portions disposed outwardly of the housing and further including a fixture for positioning the wires with respect to the insulation displacement portions such that pressing the positioning fixture down terminates the wires to the connector.

BACKGROUND ART

Many different designs of field installable modular connectors have been proposed. The desirable characteristics of field installable connectors include minimal size, ease of assembly, and reliable termination of the connector to telephone wires. Modular connectors typically include a plurality of interlocking parts, including a housing that defines a standard connector jack, a contact carrier that carries and positions a plurality of insulation displacement contacts for termination to a plurality of individual wires in a wire positioning fixture that positions individual wires for termination within each respective insulation displacement contact. The wire positioning fixture is typically secured to the housing/wire carrier by peripheral latching structural features that cooperate with structural features formed on the housing/contact carrier.

One example of this type of connector is the central latch modular telephone connector described in U.S. Pat. No. 5,118,310 to Stroede, et al, and assigned to a common assignee, which is incorporated herein by reference. The modular telephone connector of Stroede, et al. '310 consists of a housing adapted to mate with a standard telephone connector and contacts having insulation displacement portions disposed outwardly of the housing and further including a fixture for positioning the wires with respect to the insulation displacement portions. In order to terminate the wires by securing the wire positioning fixture to the housing/contact carrier, it is necessary to apply pressure to the top of the wire positioning fixture. Currently this is accomplished by means such as a pair of pliers. This is disadvantageous as it requires the user to carry around a bulky tool.

Additionally, many of the communication wires that are to be terminated to a modular connector of this type have the wires situated in twisted wire pairs with the cable for cable performance reasons. Therefore, it is necessary when terminating certain communication cables to a modular connector to separate or untwist the twisted wire pairs.

OBJECT OF THE INVENTION

It is therefore an object of the present invention to provide a simple termination tool for use in terminating a plurality of wires to a modular connector.

It is another object of the present invention to provide a simple handheld tool which can be used to untangle twisted wires of a communication cable.

In general, a termination tool for terminating a plurality of wires to a modular connector, of the type having a housing adapted to mate with a standard connector and contacts having insulation displacement portions disposed outwardly of the housing and further including a positioning fixture for positioning the wires with respect to the insulation displacement portions, includes a tool body having a first contacting section and an integrally formed upwardly angled lever section and engagement means disposed at a front end of the contacting section for engaging the tool body in a recess formed in a rear wall of the housing so as to position the contacting section above the positioning fixture.

These and other objects, together with the advantages thereof over existing prior art forms, which will become apparent from the following specification or accomplished by means hereinafter described.

DETAILED DESCRIPTION OF THE INVENTION

Figure 1:
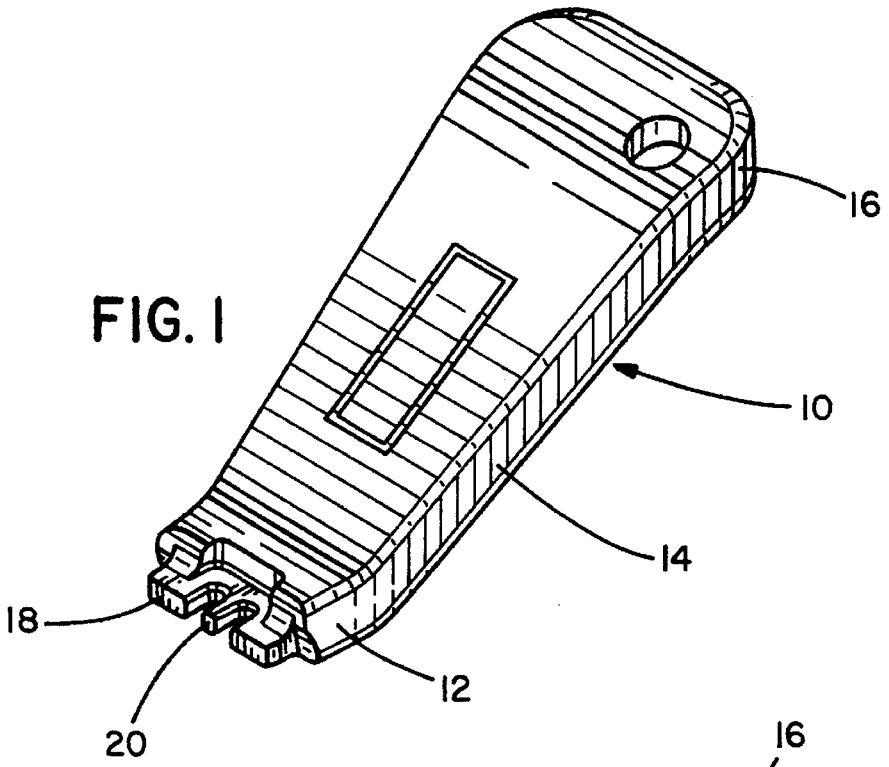
FIG. 1 is a perspective view of a termination tool for a modular connector embodying the concept of the present invention.
Figure 2:
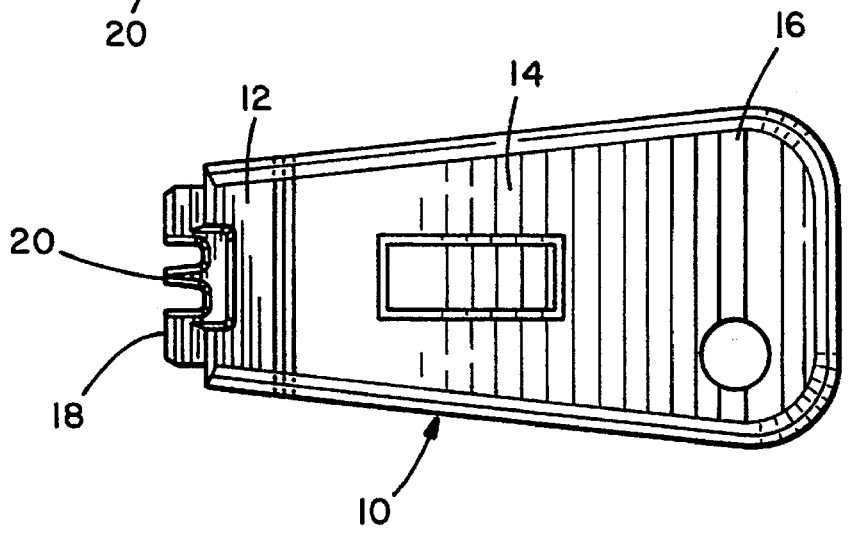
FIG. 2 is a top view of the termination tool of FIG. 1.
Figure 3:
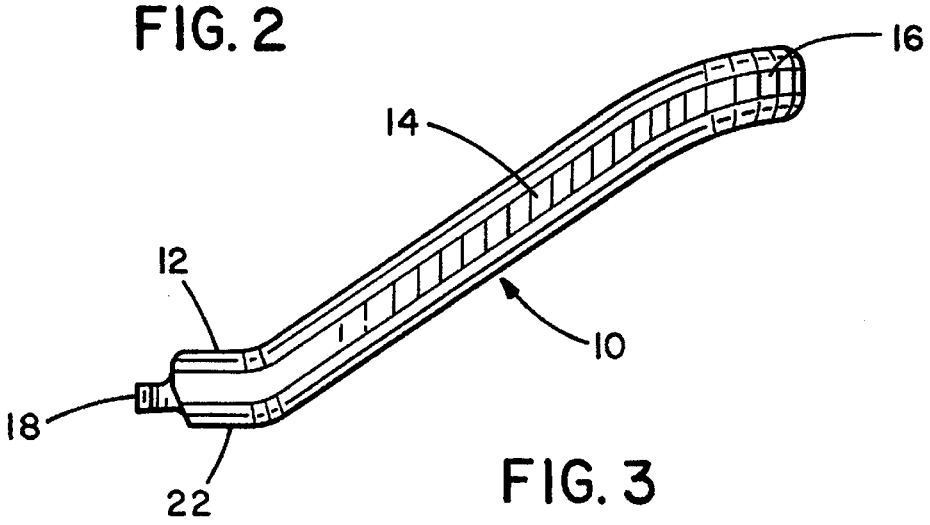
FIG. 3 is a side view of the termination tool of FIG. 1.

A termination tool embodying the concept of the present invention is designated generally by reference 10 in the accompanying drawings. As shown in FIGS. 1–3, termination tool 10 includes a first planar contacting section 12, a second upwardly angled lever section 14, that has a back pressing section 16 that curves into a horizontally oriented portion. The planar section 12 includes a contacting surface 22 formed on the underside and the front end has a pair of engagement projections 18 extending from the front end.

Figure 5:
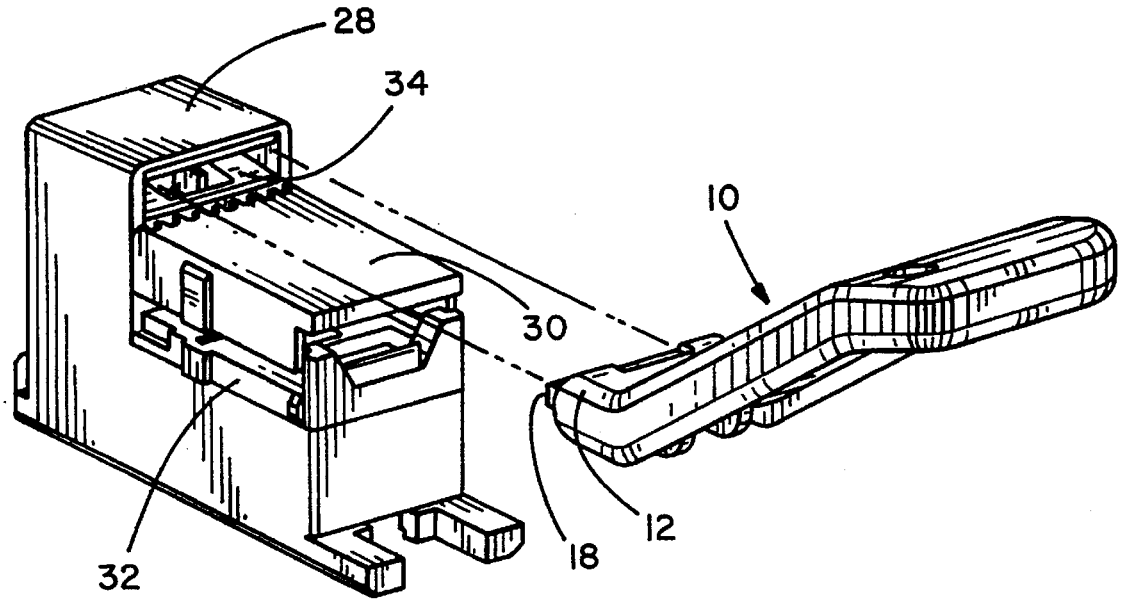
FIG. 5 is perspective view of the termination tool of the present invention shown with an unterminated modular connector.

FIG. 5 shows an example of a modular connector having a recess 34 formed in rear wall of housing 28, such that upon engagement of tool 10 with recess 34, the contacting section 12 will be on top of a positioning fixture 30 so that upon forcing the fixture 30 into latching engagement with carrier 32, it will terminate the wires (not shown) to the IDC contacts of contact carrier 32.

Figure 6:
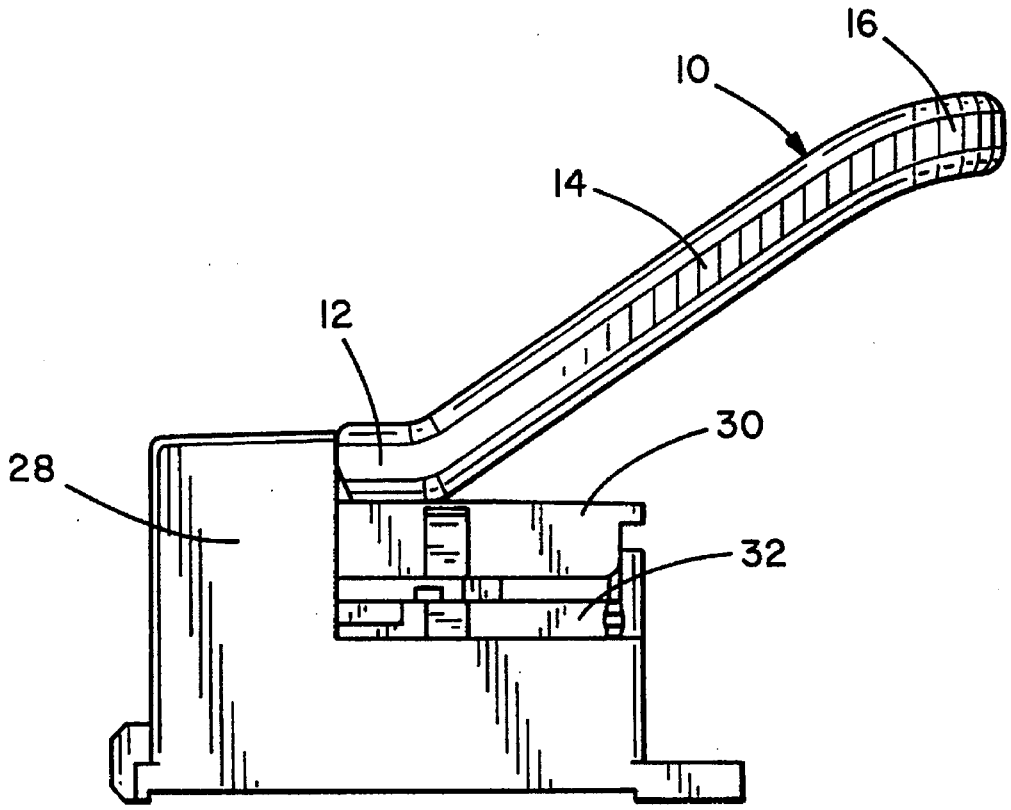
FIG. 6 is a side view of the termination tool engaged with the modular connector.
Figure 7:
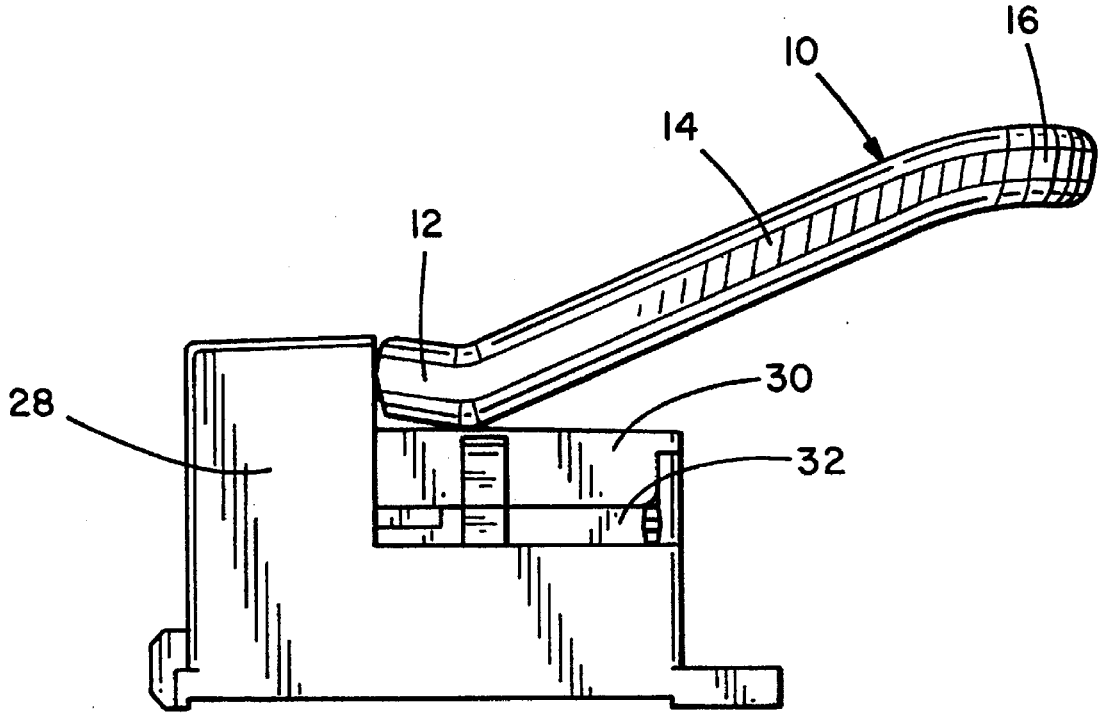
FIG. 7 is a side view of the termination tool shown terminating the modular connector.

As can be seen in FIGS. 6 and 7, as the tool 10 is engaged with housing 28, engagement projections 18 are inserted into the rear recess 34 and the contacting surface 22 of the first planar contacting section 12 is in contact with the positioning fixture 30 and upon pressing the back end 16 of the tool 10 in a downward direction, the levering of tool 10 results in the wire positioning fixture 30 terminating the individual wires onto the insulation displacement portions of the contact/carrier 32.

Figure 4:
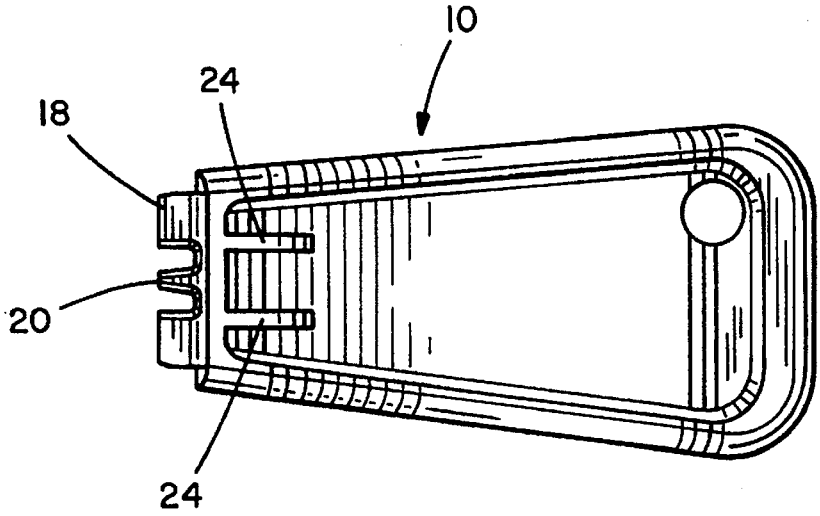
FIG. 4 is a bottom view of the termination tool of FIG. 1.

As can be seen in FIG. 4, the preferred embodiment of tool 10 has a hollowed underside. This allows for less material to be used in forming the tool. A pair of contacting ridges 24 are formed on the underside of front planar section 12 to contact and depress the positioning fixture 30 during termination of the wires.

As can be seen in FIG. 2, in the preferred embodiment the front top part of planar section 12 includes a recess which provides clearance for connectors in which a latch also engages with recess 34.

Figure 8:
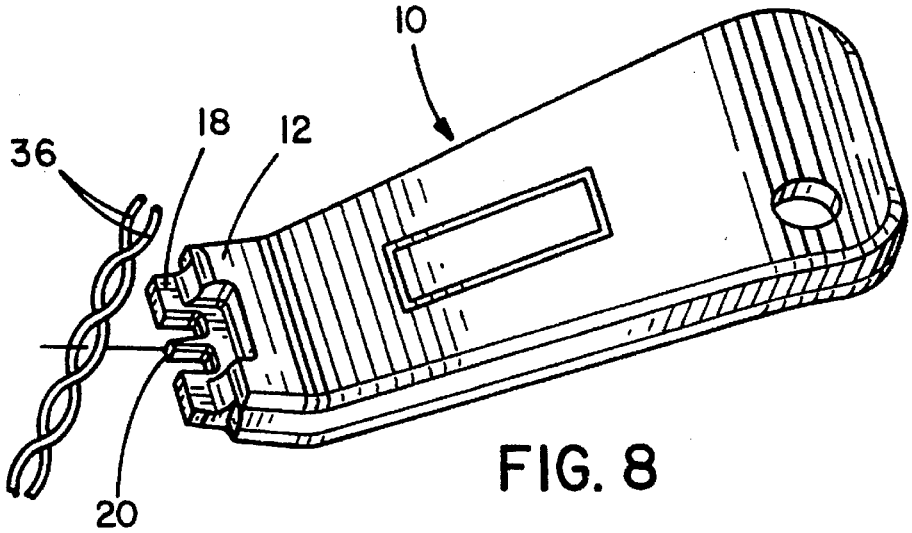
FIG. 8 is a perspective view of the tool shown with and a pair of twisted wires.
Figure 9:
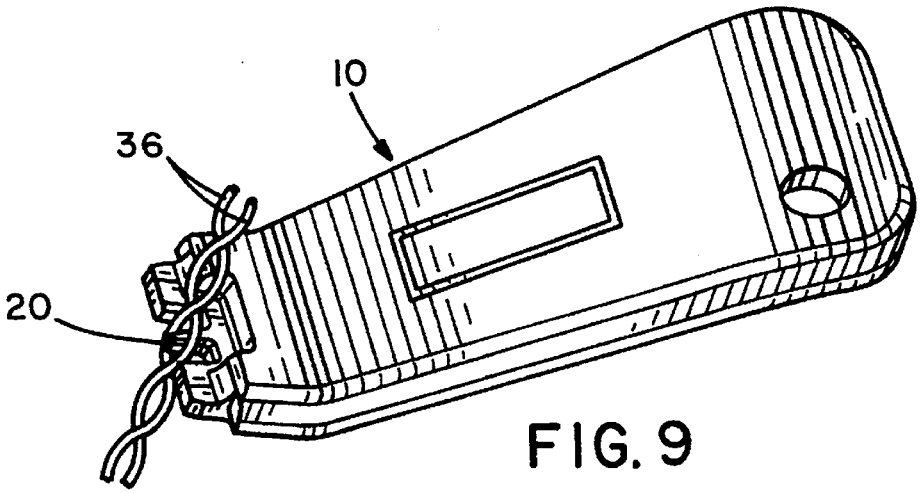
FIG. 9 is a perspective view of the tool with a blade inserted between the twisted wires.
Figure 10:
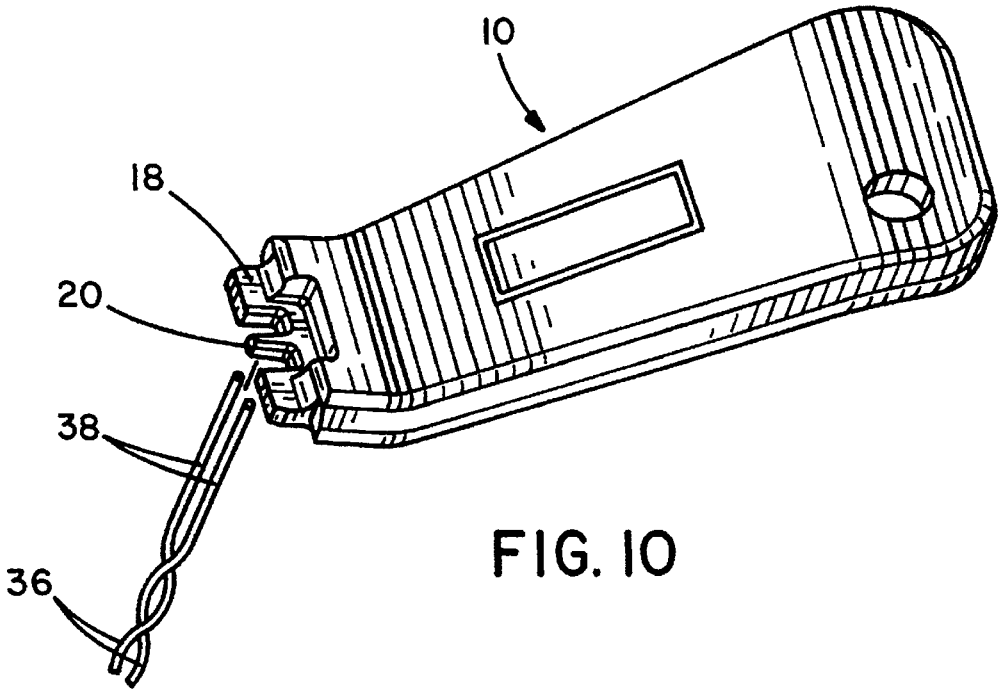
FIG. 10 is a perspective view of the tool after the blade has untwisted a section of a pair of wires.

As can be seen in FIGS. 7–9, the front end of the tool body is a horizontally oriented generally rectangular body that includes a single blade member 20 disposed between the engagement projections 18. Blade 20 is a narrowly formed vertically oriented projection which can be inserted between twisted wires 36 and pulled through the wires to untwist the wire pairs so that they can be terminated to the modular connector 28.

The tops of engagement projections 18 provide cover supports for covering the blade 20 when the tool is used to untwist wire pairs. That is, once blade 20 has been inserted between a pair of twisted wires 36, a cover such as a thumb or palm of the user or other object is placed over the blade 20 to abut against the engagement projections 18 so that the twisted wires 36 will remain engaged with the slots between blade 20 and projections 18 as the tool 10 is pulled along separating and untwisting the twisted wires 36. Projections 18 also act as protection for the narrow blade which is very small, since it is also intended to be used on small size wires such as 22–24 gauge.

While the particular preferred embodiments of the present invention have been shown and described, it will be obvious to those skilled in the art that changes and modifications may be made without departing from the teachings of our invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A termination tool for terminating a plurality of wires to a modular connector having a housing with contacts having insulation displacement portions disposed outwardly of the housing and further including a positioning fixture for positioning the wires with respect to the insulation displacement portions, comprising:

a tool body having a first substantially planar contacting section and a second integrally formed non-right angled lever section; and engagement means projecting from the contacting section for insertion of the tool body within a recess formed in the housing so as to create a pivot point for the tool with the angled lever section extending upwardly therefrom and to position the contacting section above the positioning fixture such that upon pivoting of the lever section downward the positioning fixture terminates the wires to the insulation displacement contact portions.

2. A termination tool according to claim 1, wherein the engagement means is disposed at a front end of the contacting section to engage a recess formed in a rear wall of the housing.

3. A termination tool according to claim 2, wherein the lever section includes a back pressing portion integrally formed in a curvilinear flattening direction.

4. A termination tool according to claim 2, where an underside of the contacting section includes a pair of ridges.

5. A termination tool according to claim 2, wherein the engagement means is a horizontally oriented projecting bar.

6. A termination tool according to claim 5, wherein the projecting bar comprises a pair of spaced apart projecting rib portions.

7. A termination tool according to claim 6, further including blade means centrally disposed between the pair of projecting ribs.

8. A termination tool according to claim 7, wherein the blade means is an integrally formed vertically oriented narrow blade.

* * * * *